US005131361A

United States Patent [19]

Hartmann et al.

[11] Patent Number: 5,131,361

[45] Date of Patent: Jul. 21, 1992

[54] CENTRIFUGAL GOVERNOR FOR INTERNAL COMBUSTION ENGINES

[75] Inventors: Ernst-Siegfried Hartmann, Overath; Werner Lemme, Rosrath, both of Fed. Rep. of Germany

[73] Assignee: Kloeckner-Humboldt-Deutz AG, Cologne, Fed. Rep. of Germany

[21] Appl. No.: 577,084

[22] Filed: Aug. 30, 1990

Related U.S. Application Data

[63] Continuation of Ser. No. 251,114, Sep. 29, 1988, abandoned.

[30] Foreign Application Priority Data

Oct. 1, 1987 [DE] Fed. Rep. of Germany ..... 3733160

[51] Int. Cl.[5] ..... F02D 31/00

[52] U.S. Cl. ..... 123/373; 123/364; 192/995; 74/569

[58] Field of Search ..... 123/364, 365, 373, 372; 74/569; 192/995

[56] References Cited

U.S. PATENT DOCUMENTS

| | | | |
|---|---|---|---|
| 1,549,259 | 8/1925 | Johnson | 192/995 |
| 1,974,858 | 9/1934 | Baur | 123/373 |
| 2,095,915 | 10/1937 | Burger | 123/364 |
| 2,117,248 | 5/1938 | Horst | 123/373 |
| 2,507,689 | 5/1950 | Buck | 123/373 |
| 3,185,141 | 5/1965 | Miracki | 123/373 |
| 3,495,535 | 2/1970 | Patterson | 123/373 |
| 4,603,766 | 8/1986 | Landa | 192/995 |

FOREIGN PATENT DOCUMENTS

| | | | |
|---|---|---|---|
| 1115546 | 10/1961 | Fed. Rep. of Germany | 74/569 |
| 1954834 | 5/1971 | Fed. Rep. of Germany | 123/373 |
| 2615892 | 10/1977 | Fed. Rep. of Germany | 74/569 |
| 3716174 | 11/1988 | Fed. Rep. of Germany | 123/364 |
| 0198772 | 8/1988 | Japan | 123/357 |

*Primary Examiner*—Carl Stuart Miller
*Attorney, Agent, or Firm*—Charles L. Schwab

[57] ABSTRACT

A centrifugal governor for an internal combustion engine having a bosshead (2) which can be displaced axially along a governor driving shaft (1) by centrifugal weights (3) and a governor lever (7), the pivoted position of which is controlled by the axial movement of the bosshead (2). Axial motion of the bosshead (2) is converted to pivotal motion of the governor lever (4) by a pair of bearings (5) mounted on the latter and having outer raceways (6) which roll on the bosshead (2).

8 Claims, 1 Drawing Sheet

CENTRIFUGAL GOVERNOR FOR INTERNAL COMBUSTION ENGINES

This application is a continuation of application Ser. No. 07/251,114, filed Sep. 29, 1988, now abandoned.

TECHNICAL FIELD

This invention relates to a centrifugal governor for internal combustion engines of the type having centrifugal weights which axially shift a bosshead encircling the governor driving shaft which in turn adjusts the pivoted position of a fuel control lever.

PRIOR ART STATEMENT

Centrifugal governors perform an important regulating function in the engine. For instance, a centrifugal governor may be used to adjust the leading edge of a fuel injection pump plunger responsive to the speed of the engine. Such a centrifugal governor is described in West German Patent DE-PS 814 814 in which a governor measuring element is securely connected with an engine driven governor driving shaft. The governor measuring element includes centrifugal weights which engage a bosshead with a force dependent on engine speed with the bosshead being displaced axially along the governor driving shaft. In order to convert the axial bosshead movement to pivotal movement of a governor lever, an axial thrust bearing is arranged coaxially on the governor driving shaft which can be displaced axially with the bosshead, with the support for the outer raceway of the bearing connected to the governor lever. The axial thrust bearing which surrounds the governor driving shaft is thus the connecting link between a speed responsive element or bosshead and an axial thrust component which pivots the governor lever.

The disadvantage in this arrangement lies in the fact that the axial thrust bearing, because it surrounds the governor driving shaft, has a large diameter and thus represents a relatively large component which is high in cost. The large size and high cost of the bearing places limitations on the use of the governor.

OBJECTS AND BRIEF SUMMARY OF THE INVENTION

It is an object of this invention to create a centrifugal governor for an internal combustion engine in which the interconnection between a rotating governor measuring element and the governor lever is a mechanism which is simple in design, substantially friction-free, compact and light.

This invention meets the foregoing objective by mounting at least one ball bearing on the governor lever so that its outer cover or raceway rolls on the bosshead. This ball bearing can be small and light in weight since the diameter of the governor drive shaft does not determine its size. The ball bearing is thus the connecting link or interconnection for transmitting speed responsive movement. The small, inexpensive bearing contributes to a governor which is relatively simple in design, light in weight, substantially friction-free, compact and low in cost.

In the preferred embodiment, the governor lever surrounds the governor driving shaft and two ball bearings are mounted on the governor lever at opposite sides of the governor driving shaft.

In order to most efficiently transmit speed responsive thrust, it is preferred that the axes of the ball bearings be parallel to the pivot axis of the governor lever.

Since it is advantageous to use a small diameter ball bearing and since the foreign particles which are found in motor oil can cause damage to the relatively small balls and raceways, it is preferred that the bearings be provided with cover disks or seals as found in commercially available sealed bearings.

BRIEF DESCRIPTION OF THE DRAWINGS

One embodiment of the invention is shown in the drawings in which.

DETAILED DESCRIPTION OF THE DRAWINGS

Figure 2:
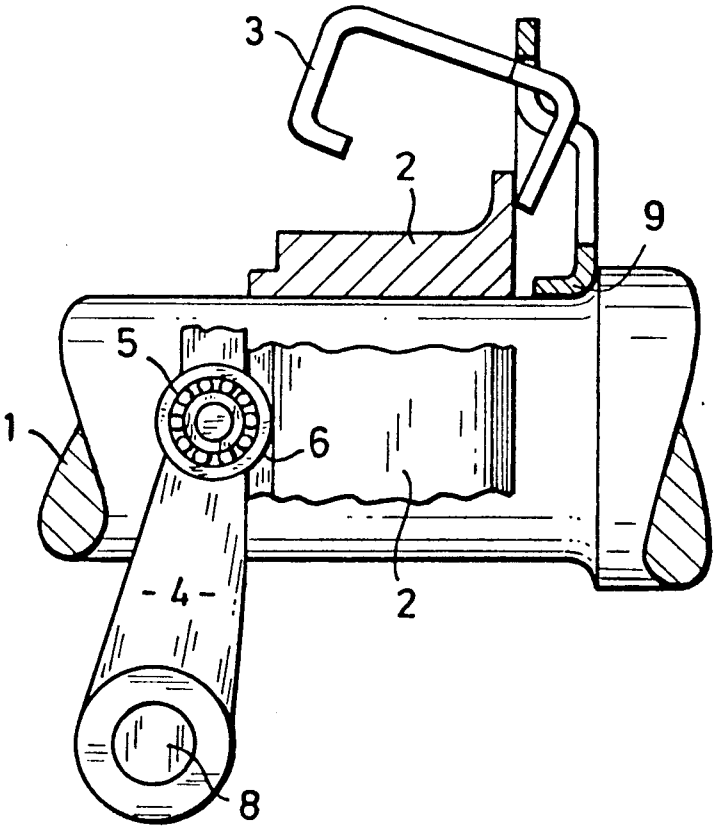
FIG. 2 is an end view of the governor shown in FIG. 1.
Figure 1:
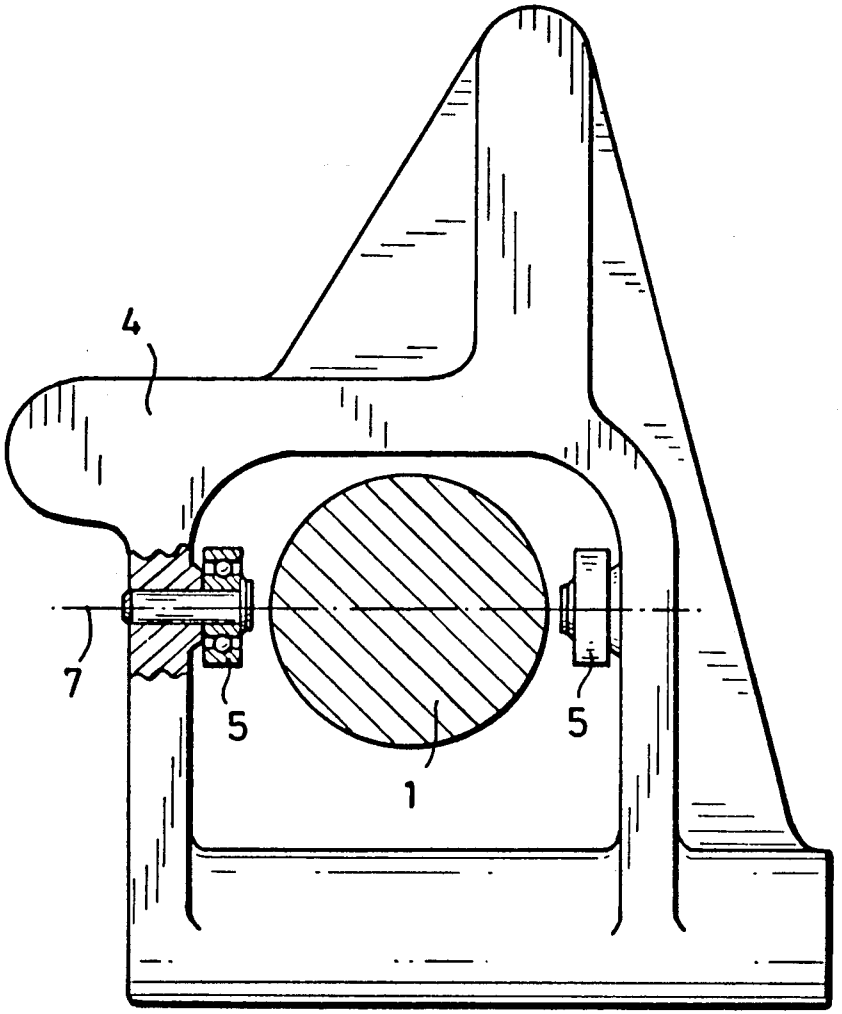
FIG. 1 is a side view of a centrifugal governor with parts broken away for illustration purposes.

The centrifugal governor shown in the drawings includes a governor driving shaft 1 extending through a centrifugal weight support 9 which is securely connected with an engine driven governor driving shaft 1 to rotate therewith. Circumferentially spaced centrifugal weights 3 are mounted on fulcrums on the centrifugal weight support 9 with portions in axial thrust transmitting engagement or abutment with a bosshead 2 which encircles and is axially shiftable relative to the governor driving shaft 1. Responsive to the speed of the governor driving shaft 1 and the centrifugal force acting on the centrifugal weights 3, the bosshead 2 is displaced axially by the weights 3 along the governor driving shaft 1. This axial displacement of the bosshead 2 is converted to a pivotal movement of the governor lever 4 which pivots about an axis 8 spaced below the axis of the shaft 1. In order to do this at least one ball bearing 5 is mounted on the governor lever 4 is spaced relation to its pivot axis 8 so that its outer raceway 6 rolls on an axial facing annular surface or shoulder on the bosshead 2. The axially facing annular surface is flat, encircles the shaft 1 and is disposed at right angles to the axis of the shaft 1.

In the embodiment of the invention illustrated in the drawings, the governor lever 4 surrounds the governor driving shaft 1 and two ball bearings 5 are mounted on the governor lever 4 at diametrically opposite sides of the governor driving shaft 1.

The common axis 7 of the two ball bearings 5 is parallel to and spaced from the axis 8 on which the governor lever 4 pivots. This arrangement minimizes the forces acting on the bearings 5. The axis 7 lies in a plane disposed at right angles to the axis of the governor driving shaft 1.

In order to prevent the foreign particles found in motor oil from entering the ball bearings 5 and damaging the relatively small balls and the bearing raceways, it is preferred to seal off the ball bearing 5 with appropriate disks or seals.

An important advantage of the illustrated embodiment of the invention is that the ball bearings 5 are small and relatively easy to seal. The centrifugal governor thus produced is compact in size, is relatively inexpensive, is light in weight and has low friction, thus providing a reliable, compact, low cost and low maintenance governor having a wide application in internal combustion engines.

The embodiments of the invention in which an exclusive property or privilege is claimed are defined as follows:

1. A centrifugal governor for an internal combustion engine including a governor driving shaft (a) comprising: a bosshead (2) surrounding and rotating with said driving shaft in generally coaxial and axially shiftable relation thereto, pivotable centrifugal weights (3) mounted on said driving shaft in axial thrust transmitting engagement with one axial end of said bosshead (2), a governor lever (4) pivotable about its pivot axis (8) by the axial movements of the bosshead (2), said bosshead (2) having an axially facing flat annular surface encircling said shaft (1) to form a continuous circular pathway at the other axial end of said bosshead, at least one ball bearing (5) mounted on said governor lever (4) in radially spaced relation to said shaft on an axis traverse to the axis of said driving shaft and having an outer raceway (6) rolling on said flat annular surface of said bosshead (2), said ball bearing having an outer diameter substantially smaller than the diameter of said shaft.

2. The centrifugal governor of claim 1 wherein said governor lever (4) surround said governor driving shaft (1) and two ball bearings are mounted on said lever (4) on diametrically opposite sides of said governor driving shaft (1) and each have an outer raceway (6) in rolling engagement with said flat surface of said bosshead (2).

3. The centrifugal governor of claim 2 wherein said ball bearings (5) are disposed on a common bearing axis (7) which is parallel to said axis (8) about which said governor lever (4) rotates.

4. The centrifugal governor of claim 3 wherein said ball bearings (5) are sealed bearings.

5. The centrifugal governor of claim 1 wherein said ball bearing (5) is mounted on said governor lever on a bearing axis (7) lying in a plane at right angles to the axis of said governor driving shaft (1).

6. The centrifugal governor of claim 5 wherein said governor lever (4) surrounds said governor driving shaft (1) and two ball bearings (5) are mounted on said governor lever (4) on said bearing axis (7) at opposite sides of said governor driving shaft (1) and the outer raceways (6) of said bearings (5) bear axially against said axially facing flat surface on said bosshead (2).

7. The centrifugal governor of claim 1 wherein said pivot axis (8) is parallel to the bearing axis (7) of said bearing (5).

8. The centrifugal governor of claim 7 wherein said bearing axis (7) lies in a plane at right angles to the axis of said governor driving shaft (1).

* * * * *

UNITED STATES PATENT AND TRADEMARK OFFICE

CERTIFICATE OF CORRECTION

PATENT NO. : 5,131,361

DATED : Jul. 21, 1992

INVENTOR(S) : Ernst-Siegfried Hartmann and Werner Lemme

It is certified that error appears in the above-identified patent and that said Letters Patent is hereby corrected as shown below:

Column 3, line 5 "(a)" should be --- (1) ---;

Column 3, line 23 "surround" should be --- surrounds ---.

Signed and Sealed this

Tenth Day of August, 1993

*Attest:*

Michael K. Kirk

MICHAEL K. KIRK

*Attesting Officer*

*Acting Commissioner of Patents and Trademarks*